US007406952B2

(12) United States Patent
Frank et al.

(10) Patent No.: US 7,406,952 B2
(45) Date of Patent: Aug. 5, 2008

(54) METHOD AND DEVICE FOR CONTROLLLING AN INJECTOR

(75) Inventors: Joachim Frank, Coburg (DE); Hellmut Freudenberg, Grossberg (DE); Manfred Weigl, Viehhausen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 11/722,238

(22) PCT Filed: Dec. 2, 2005

(86) PCT No.: PCT/EP2005/056442

§ 371 (c)(1),
(2), (4) Date: Jun. 20, 2007

(87) PCT Pub. No.: WO2006/074842

PCT Pub. Date: Jul. 20, 2006

(65) Prior Publication Data

US 2007/0250248 A1 Oct. 25, 2007

(30) Foreign Application Priority Data

Jan. 12, 2005 (DE) ..... 10 2005 001 498

(51) Int. Cl.
*F02M 37/04* (2006.01)

(52) U.S. Cl. ..... 123/498

(58) Field of Classification Search ..... 123/498
See application file for complete search history.

(56) References Cited

U.S. PATENT DOCUMENTS 6,062,489 A * 5/2000 Tokumaru ..... 239/124
6,253,736 B1 * 7/2001 Crofts et al. ..... 123/498
6,420,817 B1 * 7/2002 Ricci-Ottati et al. ... 310/316.01
6,478,013 B1 * 11/2002 Boecking ..... 123/467
6,491,027 B1 12/2002 Freudenberg et al. ..... 123/490
6,539,925 B2 * 4/2003 Rueger et al. ..... 123/490
6,619,268 B2 * 9/2003 Rueger et al. ..... 123/490
6,705,291 B2 * 3/2004 Rueger et al. ..... 123/467

(Continued)

FOREIGN PATENT DOCUMENTS

DE 19905340 2/1999

(Continued)

OTHER PUBLICATIONS

International Search Report And Written Opinion; PCT/EP2005/056442; 5 pgs.

*Primary Examiner*—Thomas N Moulis
(74) *Attorney, Agent, or Firm*—Baker Botts L.L.P.

(57) ABSTRACT

An injector has a valve pin whose position is adjustable according to the pressure prevailing in a control chamber and which blocks a fluid flow through at least one injection port in a closed position. The injector has a control chamber that is hydraulically coupled to a high-pressure fluid reservoir, a piezo actuator, and a control valve which hydraulically connects and disconnects the control chamber, the piezo actuator acting upon said control valve. A combination of a triggering period for the piezo actuator and electric power that is to be fed to the piezo actuator is varied from a predefined initial combination to a target combination in which a pressure curve is detected that is characteristic of a movement of the control valve out of the closed position thereof without fluid being proportioned through the injection port.

20 Claims, 5 Drawing Sheets

U.S. PATENT DOCUMENTS

| | | | | |
|---|---|---|---|---|
| 6,837,221 | B2 * | 1/2005 | Crofts et al. | 123/467 |
| 6,885,131 | B2 | 4/2005 | Hirn et al. | 310/316.01 |
| 7,269,500 | B2 * | 9/2007 | Cochet et al. | 701/114 |
| 7,305,971 | B2 * | 12/2007 | Fujii | 123/479 |

FOREIGN PATENT DOCUMENTS

| | | |
|---|---|---|
| DE | 19954023 | 11/1999 |
| DE | 10012607 | 3/2000 |
| DE | 10024662 | 5/2000 |
| DE | 10319530 | 4/2003 |
| EP | 0856654 | 2/1998 |
| EP | 1087120 | 9/2000 |
| WO | 01/63121 | 8/2001 |
| WO | 02/092985 | 11/2002 |

* cited by examiner

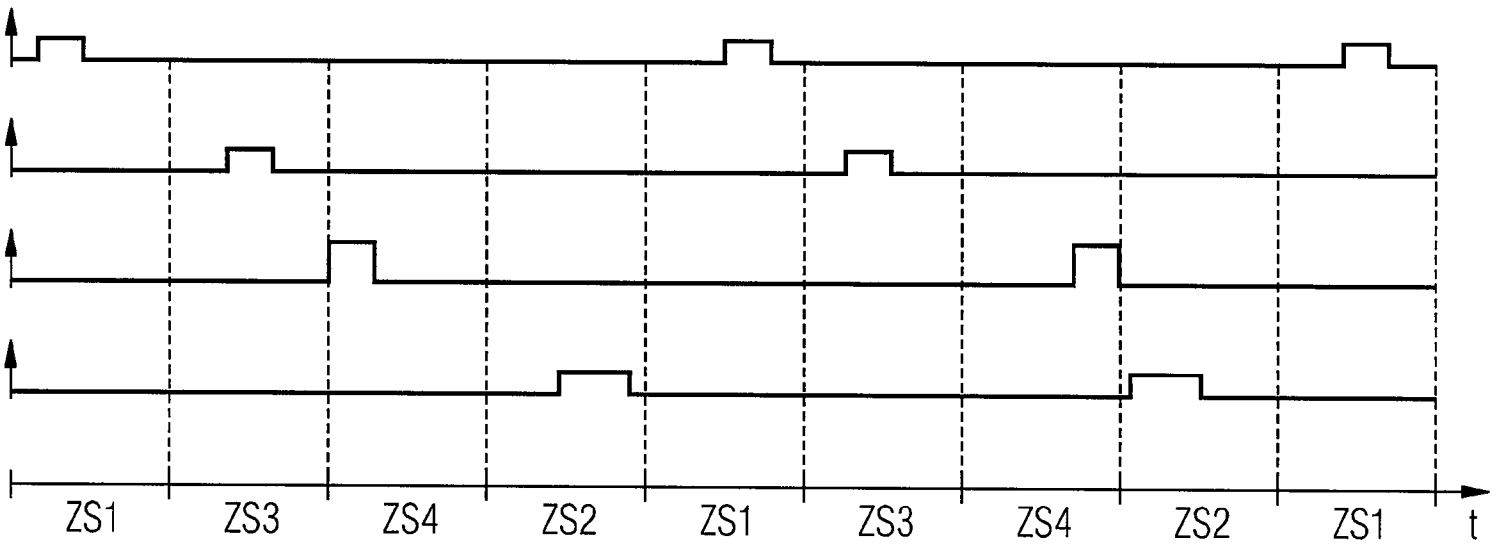
FIG 6A
FIG 6B
FIG 6C
FIG 6D
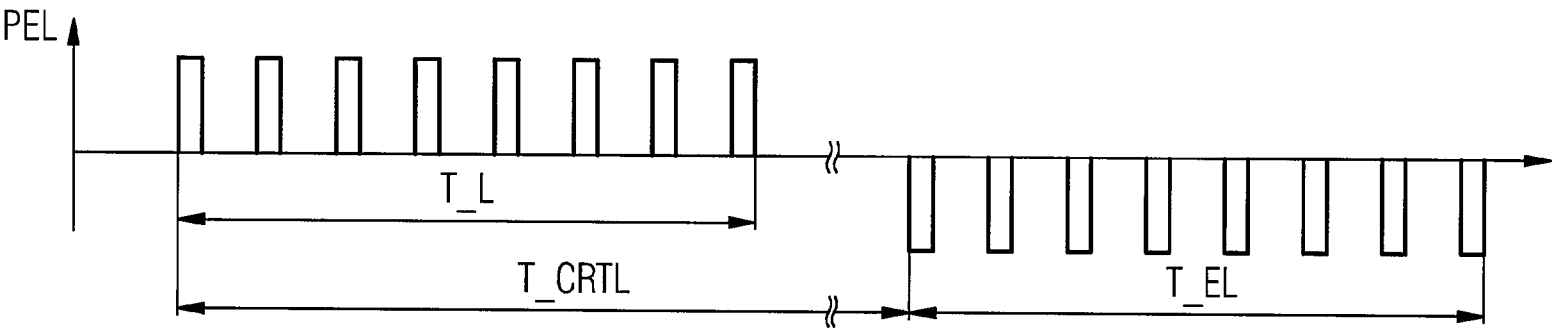
FIG 7

METHOD AND DEVICE FOR CONTROLLLING AN INJECTOR

CROSS-REFERENCE TO RELATED APPLICATIONS

This application is a U.S. national stage application of Internation Application No. PCT/EP2005/056442 filed Dec. 2, 2005, which designates the United States of America, and claims priority to German application number DE 10 2005 001 498.4 filed Jan. 12, 2005, the contents of which are hereby incorporated by reference in their entirety.

TECHNICAL FIELD

The invention relates to a method and a device for controlling an injector which is embodied in particular for metering fuel to an internal combustion engine.

BACKGROUND

Increasingly stringent statutory provisions relating to the permissible pollutant emissions of internal combustion engines which are disposed in motorized vehicles make it necessary to adopt various measures by means of which the pollutant emissions can be reduced. One starting point in this endeavor is to reduce the pollutant emissions generated during the combustion process of the air/fuel mixture. The formation of soot in particular is greatly dependent on the preparation of the air/fuel mixture in the respective cylinder of the internal combustion engine. In order to achieve a very good fuel mixture preparation, fuel is increasingly metered under very high pressure. In the case of diesel internal combustion engines, the fuel pressures reach as high as 2000 bar. Injection valves having a piezo actuator as the final control element are becoming increasingly widely accepted for applications of this kind. Piezo actuators are characterized by very short response times. Injection valves of this type are thus possibly suited for metering fuel several times over within one working cycle of a cylinder of the internal combustion engine fuel.

A particular good fuel mixture preparation can be achieved if one or more pre-injections, which are also referred to as pilot injections, are performed prior to a main injection, with possibly a very small fuel mass being required to be metered for the individual pre-injection. Precise control of the injection valve is very important in particular for cases of this type.

A method for detecting injection events of an injection valve having a piezoelectric actuator is known from WO 01/63121. The injection valve comprises an injector body having a control chamber to which is assigned a control valve which controls the fuel pressure in the control chamber. The piezoelectric actuator acts on the control valve. A voltage is applied to the piezoelectric actuator in such a way that the resulting stroke of the piezoelectric actuator actuates the control valve. An axial movement of a nozzle needle away from a valve seat is detected as a function of an increase in the voltage drop at the piezoelectric actuator. A termination of the movement of the nozzle needle is detected on the basis of an abrupt decrease in the voltage at the piezoelectric actuator.

SUMMARY

Precise control of an injectorcan be achieved by a method and device for controlling an injector comprising a nozzle needle whose position is adjustable as a function of a pressure in a control chamber and which in a closed position prevents a fluid flow through at least one injection port and otherwise releases said fluid flow, the control chamber which is hydraulically coupled to a high-pressure fluid accumulator, a piezo actuator, and a control valve which in its closed position hydraulically decouples the control chamber from a low-pressure chamber which outside of the closed position hydraulically couples the control chamber to the low-pressure chamber and upon which the piezo actuator acts, wherein the device is operable to and the method comprises the step of varying a combination of a control period of the piezo actuator and an electrical energy to be supplied to the piezo actuator starting from a predefined initial combination to a target combination in which a pressure curve is recorded which is characteristic of a movement of the control valve out of its closed position without a metering of fluid taking place through the injection port.

BRIEF DESCRIPTION OF THE DRAWINGS

Exemplary embodiments of the invention are explained below with reference to the schematic drawings, in which:

FIGS. 6A to 6D show time curves of control signals for the injectors, and FIG. 7 shows a time curve of one of the control signals during a charge period.

DETAILED DESCRIPTION

Figure 1:
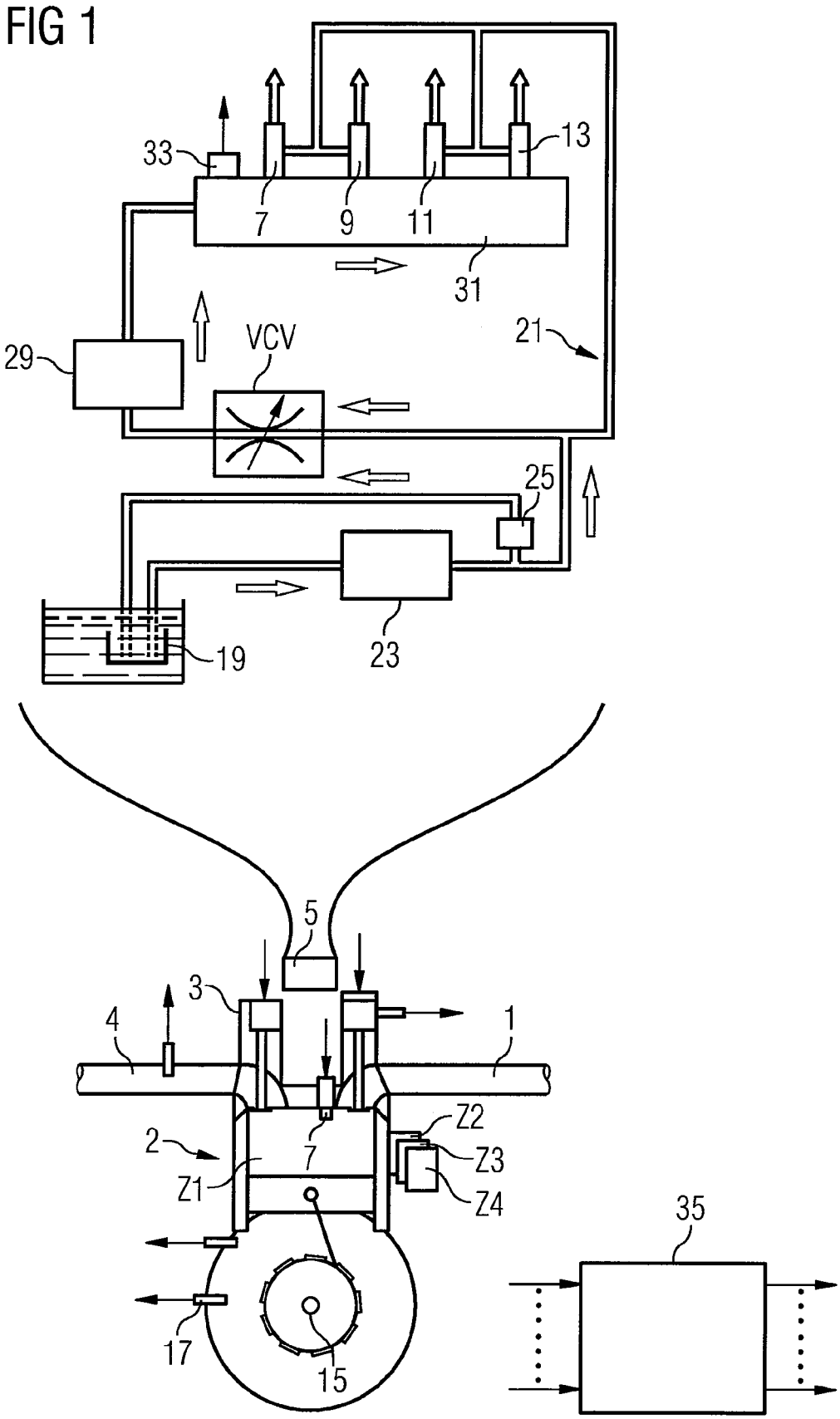
FIG. 1 shows an internal combustion engine having a plurality of injectors.

In a method and a corresponding device for controlling an injector, which can also be referred to as an injection valve, the injector has a nozzle needle whose position is adjustable as a function of a pressure in a control chamber and which in a closed position prevents a fluid flow through at least one injection port in a nozzle body and otherwise releases said fluid flow. The injector further comprises a control chamber which is hydraulically coupled to a high-pressure fluid accumulator, a piezo actuator, and a control valve which in its closed position hydraulically decouples the control chamber from a low-pressure chamber, which outside of its closed position hydraulically couples the control chamber to the low-pressure chamber, and upon which the piezo actuator acts. A combination of a control period of the piezo actuator and electrical energy supplied to the piezo actuator is varied starting from a predefined initial combination to a target combination in which a pressure curve is recorded which is characteristic of a movement of the control valve out of its closed position, without a metering of fluid taking place through the injection port. The target combination is a simple and precise measure for an idle stroke of the piezo actuator, which idle stroke is an extremely important parameter in particular in connection with the metering of the smallest possible fluid quantities through the injector.

In this way it is thus easily possible to determine at arbitrarily predefinable time intervals over the operating period of the injector valve the target combination as a measure for the current idle stroke, which can change considerably over the lifetime of the injector and possibly can also be subject to temporary fluctuations. Influencing variables for the idle stroke include, for example, the temperature, wear-and-tear, and aging of the piezo actuator. Depending on the target combination, the electrical energy to be supplied to the piezo actuator and/or the control period of the piezo actuator can then be corrected for subsequent injection operations. The target combination can, however, also be used advantageously in the context of controlling the injector for other purposes, such as, for example, a diagnosis.

According to an embodiment, the combination of the control period and the electrical energy to be supplied is varied starting from the predefined initial position to the target combination in an operating state in which an actuating element for adjusting a fluid delivery to the high-pressure fluid accumulator is in its closed state. This has the advantage that the recorded pressure curve is then more independent of interference factors which are caused by a delivering of the fluid to the high-pressure fluid accumulator. Thus, it is then easier to precisely detect the pressure curve which is characteristic of the movement of the control valve out of its closed position without a metering of fluid taking place through the injection port. A further consequence of this is in turn that the target combination can be determined more precisely.

According to a further embodiment, the combination of the control period and the supplied electrical energy is varied by means of a charge period during which the piezo actuator is supplied with electrical energy, which charge period is longer than that during an operation phase of the injector in which a metering of fluid is intended. In this way the generation of sound which can be perceived as unpleasant by a user can be reduced.

According to a further embodiment, the combination of the control period and the supplied electrical energy is varied by means of a discharge period during which electrical energy is removed from the piezo actuator, which discharge period is longer than that during the operation phase of the injector in which a metering of fluid through the injection port is intended. In this way, too, the sound which is perceived as unpleasant by a user is reduced.

According to a further embodiment, a commencement of succeeding control periods is varied in relation to the respective cylinder segment. In this way the sound spectrum can be set in a targeted manner by the controlling of the control valve in order thereby to make the subjective perception of the sound by the user as less objectionable.

According to a further embodiment, a termination of succeeding control periods is varied in relation to the respective cylinder segment. In this way, too, the sound spectrum generated as a result of the controlling of the control valve can be set in a targeted manner in order thereby to make the subjective perception of the sound by the user as less objectionable.

According to a further embodiment, the commencement of succeeding control periods for different injectors, all of which are assigned for example to an internal combustion engine, is varied in relation to the respective cylinder segment. In this way, too, the sound spectrum generated as a result of the controlling of the respective control valves can be suitably set.

According to a further embodiment, the termination of succeeding control periods for different injectors is varied in relation to the respective cylinder segment. In this way, too, the sound spectrum generated as a result of the controlling of the respective control valves can be easily set.

Elements of identical construction or function are identified by the same reference symbols throughout the figures.

An internal combustion engine (FIG. 1) comprises an intake tract 1, an engine block 2, a cylinder head 3, an exhaust tract 4 and a feed device 5 for fuel. Embodied in the internal combustion engine are a plurality of cylinders Z1 to Z4 to which injectors 7, 9, 11, 13 are assigned, respectively. A crankshaft 15 is provided to which is assigned a crankshaft angle sensor 17 which measures the current crankshaft angle, from which a rotational speed of the crankshaft can then also be derived.

The feed device 5 for fuel comprises a fuel tank 19 and a low-pressure area 21 which is either directly hydraulically coupled to the fuel tank 19 or hydraulically coupled to the fuel tank 19 via a low-pressure pump 23. Preferably also provided is a regulator 25 by means of which a pressure can be set in the low-pressure area 21. A high-pressure pump 29 is hydraulically coupled on its input side to the low-pressure area 21 via a volume flow control valve VCV. The high-pressure pump 29 is hydraulically coupled on its output side to a high-pressure fluid accumulator 31 and thus delivers fluid, in particular fuel, to the high-pressure fluid accumulator 31. By means of the volume flow control valve VCV it is possible to set a volume flow which is delivered to the high-pressure fluid accumulator 31 by the high-pressure pump 29. The volume flow control valve VCV can be embodied separately from the high-pressure pump 29 or also as a single structural unit with the high-pressure pump 29.

Figure 2:
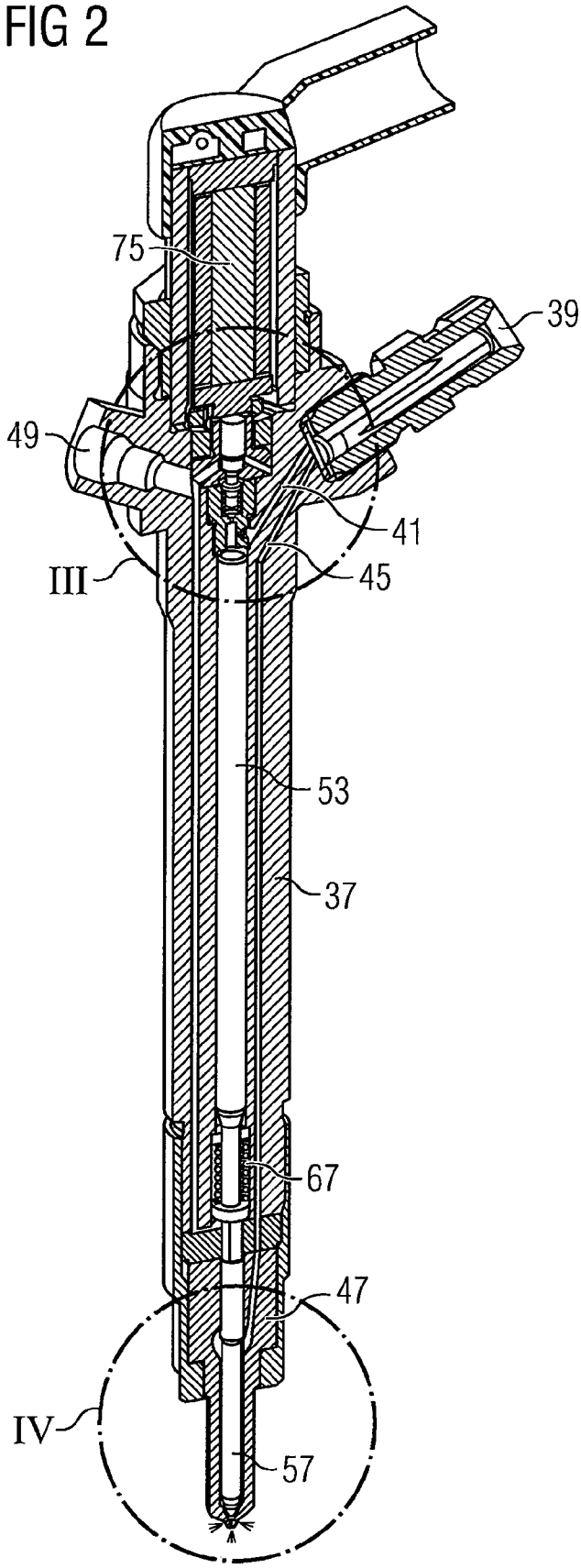
FIG. 2 shows one of the injectors according to FIG. 1.

Disposed on the high-pressure fluid accumulator 31 is a fuel pressure sensor 33 which measures the pressure in the high-pressure fluid accumulator. The measured signal of the high-pressure sensor is thus representative of a pressure curve of the fluid contained in the high-pressure fluid accumulator 31. The injectors 7, 9, 11, 13 are hydraulically coupled to the high-pressure fluid accumulator 31 via a respective high-pressure terminal (FIG. 2).

Also provided is a control device 35 which generates actuating signals for controlling actuating drives of the internal combustion engine as a function of measured variables which are recorded by sensors. The control device 35 has corresponding inputs via which the measured signals of the sensors can be recorded, as well as a program memory and a data memory and an arithmetic-logic unit and output stages for controlling the actuating drives of the internal combustion engine.

Figure 3:
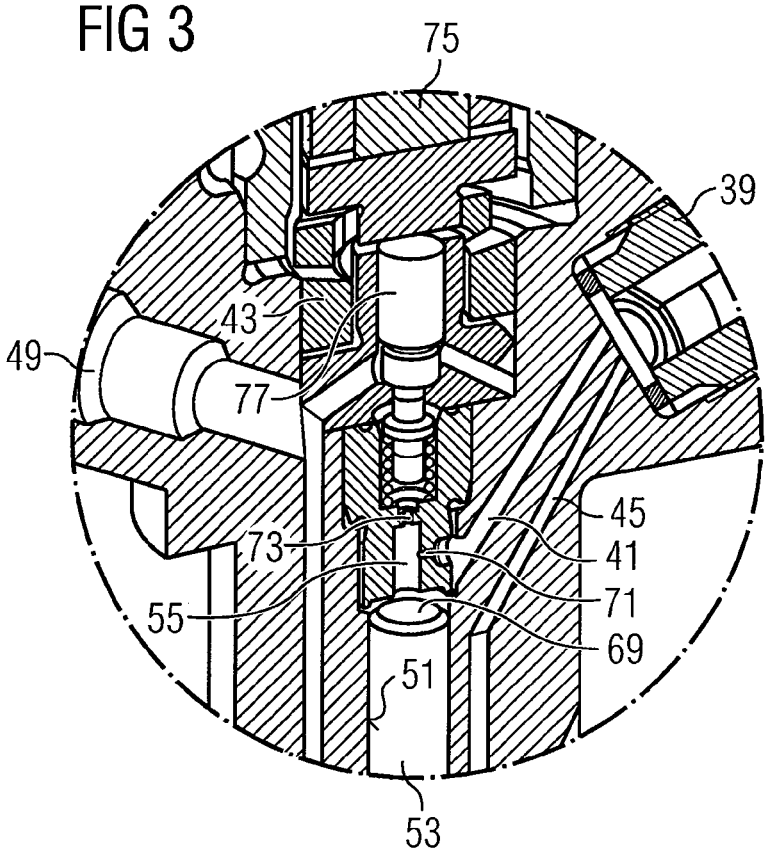
FIG. 3 shows a first magnified view of a section of the injector according to FIG. 2.
Figure 4:
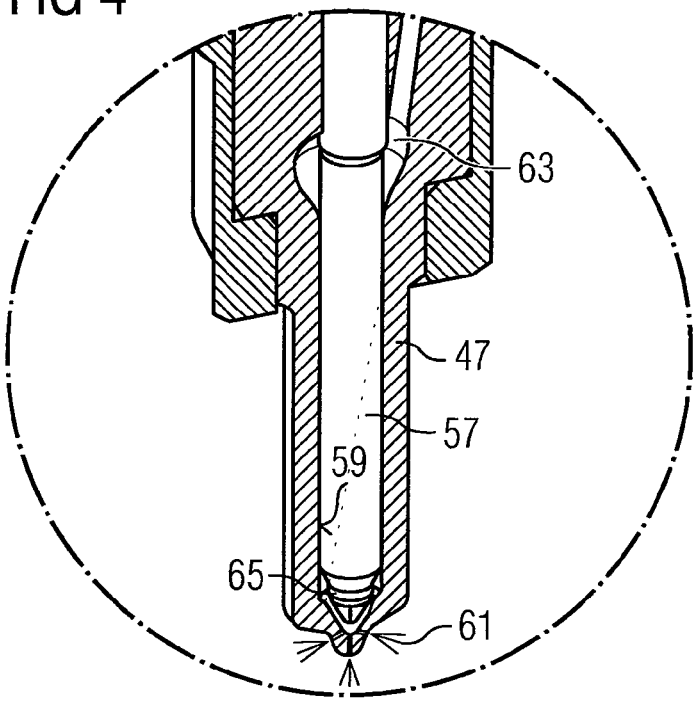
FIG. 4 shows a second magnified view of a further section of the injector according to FIG. 2.

The injectors 7-13 are identical in design and are explained in more detail below with reference to FIGS. 2 to 4. The injector 7-13 comprises an injector housing 37 which accommodates the high-pressure terminal 39 which is hydraulically coupled to the high-pressure fluid accumulator 31. The high-pressure terminal 39 is hydraulically coupled via a first high-pressure borehole 41 to a control valve 43 which is accommodated in the injector housing 37. A second high-pressure borehole 45 extends from the high-pressure terminal 39 through the injector housing 37 into a nozzle body 47.

Also embodied in the injector housing 37 is a low-pressure chamber 49 which is hydraulically coupled to the low-pressure area 21. If the low-pressure pump 23 is present, the low-pressure chamber 49 can also be directly hydraulically coupled to a return fuel line to the fuel tank 19.

Embodied in the injector housing 37 is a recess 51 of the injector housing 37 in which a control piston 53 is disposed and guided. A control chamber 55 of the control valve 43 adjoins an end face 69 of the control piston 53 and is embodied in the free space between the end face and the control valve 43.

A free space of the recess 51 of the injector housing 37 in the area of an end of the control piston 53 which faces away from the control chamber 55 is hydraulically coupled to the low-pressure chamber 49. A nozzle needle 57 is mechanically coupled to the control piston 53 and is disposed in a recess 59 in the nozzle body 47. In a closed position of the nozzle needle 57, the latter prevents a fluid flow through an injection port 61 which is embodied in the nozzle body 57. Outside of the closed position, the nozzle needle 57 releases the fluid flow through the injection port 61. If a plurality of injection ports 61 are present, the nozzle needle 57, in its closed position, prevents the fluid flow through all its assigned injection ports 61 and otherwise releases said fluid flow.

The position of the nozzle needle 57 is dependent on a balance of forces which act on the nozzle needle 57. A first force is caused by the pressure in the control chamber 45 which acts on the end face 69 of the control piston. A second force is coupled in due to the pressure which acts upon the surface of a high-pressure shoulder 63 and upon the needle dome 65. A third force is caused by a spring force of a nozzle spring 67. The position of the nozzle needle is dependent on the balance of the first to third forces.

The control chamber 55 is hydraulically coupled to the first high-pressure borehole 41 via an inlet throttle 71. The control chamber 55 can also be hydraulically coupled to the low-pressure chamber 49 via an outlet throttle 73 as a function of the switch position of the control valve 43.

Associated with the control valve 43 is a piezo actuator 75 whose axial extension is dependent on the electrical energy supplied to it. The piezo actuator 75 acts on a valve body 77 of the control valve 43 and thus determines the switch position of the control valve 43. An idle stroke between the piezo actuator 75 and the valve body 77 is given by a play between the piezo actuator 75 and the valve body 77 in a state in which no electrical energy is supplied to the piezo actuator 75. However, the idle stroke also includes a continuous increase in force, caused by an elastic twisting of the piezo actuator 75 in the injector 7-13, when electrical energy is supplied until the control valve opens. Supplying electrical energy within the idle stroke of the piezo actuator 75 consequently does not lead to a lengthening of the piezo actuator 75 which acts on the side facing the valve body 77 when the piezo actuator 75 is in contact with the valve body 77. In particular at very high pressures in the control chamber 55, the valve body 77 can for example already be in contact with the piezo actuator 75 even when the latter is not supplied with electrical energy.

Thus, if the control valve 43 is in its closed position, no fluid can be discharged via the outlet throttle 73 and consequently the pressure increases in the control chamber 55 until it reaches approximately the pressure in the high-pressure fluid accumulator 31. If the control valve 43, i.e. in particular the valve body 77, moves out of its closed position, fluid can flow out from the control chamber 55 via the outlet throttle 73 past the valve body 77 to the low-pressure chamber 49. As a result the pressure in the control chamber 55 drops as a function of the ratio of the throttle effects of the outlet throttle and the inlet throttle and, if the valve body 77 releases such a small free cross-section, the discharging of fluid is throttled in this area too, also as a function of the position of the valve body 77.

As the pressure in the control chamber 55 drops, the first force acting on the nozzle needle 57 via the control piston 53 also decreases.

Even when the control valve 43 is located in its closed position there is a leakage from the control chamber 55 to the low-pressure chamber 49. The leakage is caused by fluid which flows from the control chamber 55 through a gap between the wall of the recess 51 of the injector housing 37 and the control piston 53 through to the low-pressure chamber 49. Said leakage is pressure-dependent and increases as the pressure in the control chamber rises, possibly reinforced by a slight widening of the gap which occurs at high pressures due to the high forces.

Alternatively the nozzle needle 57 can be hydraulically coupled to the control chamber 55 and consequently the control piston 53 can be dispensed with. In this case the leakage of fluid in the control chamber 55 is negligible when the control valve 43 is in its closed position.

A program for controlling the injector 7-13 is resident in a program memory in the control device 35 and is executed during the operation of the internal combustion engine, and moreover preferably for each of the injectors 7, 9, 11, 13.

The program for controlling the injectors according to the following steps is suitable for determining a measure for the idle stroke of the control valve.

The program is started in a step S1 (FIG. 5) in which variables are initialized where applicable. The program can be started basically at any time during the operation of the internal combustion engine. Preferably the program is started when no fuel is being delivered to the high-pressure fluid accumulator 31 and preferably also when no fuel is to be metered into the combustion chambers of the cylinders Z1 to Z4 via the injectors 7 to 13.

In a step S3, a charge period T_L and preferably a discharge period T_EL are determined. The charge period T_L, and/or the discharge period T EL can correspond to those times that are provided for the operation of the injectors 7-13 with metering of fuel. However, they can also be different from these values, in particular greater and accordingly either permanently predefined or specified as a function of at least one operating variable of the internal combustion engine, where operating variables include the measured variables of the sensors and variables derived therefrom.

In a step S5, a control period T_CTRL of the piezo actuator 75 is assigned a start control period T_CTRL_ST. In addition, an electrical energy E to be supplied to the piezo actuator 75 is assigned a start energy E_ST. The start energy E_ST and the start control period T_CTRL_ST for the piezo actuator 75 are preferably predefined such that a correspondingly executed control pulse definitely does not result in fuel being metered through the injection port 61 into one of the combustion chambers of the cylinders Z1 to Z4. The control period T_CTRL_ST is preferably representative of a time period which commences with the start of the supplying of electrical energy to the piezo actuator 75 and which terminates with a discharge process of the piezo actuator. Preferably the discharge process is started at the end of the time period.

In a step S7, which is preferably but not necessarily present, a check is then made to determine whether the volume flow control valve VCV is in its closed state CL, in which no or only a slight leakage flow of fluid flows through the volume flow control valve VCV to the high-pressure pump 29 and consequently also no fluid or only the leakage flow of the volume flow control valve VCV is delivered to the high-pressure fluid accumulator 31 by the high-pressure pump 29.

If the condition of step S7 is not met, the program is terminated in a step S15.

Otherwise the processing is continued in a step S9 in which the piezo actuator 75 is activated for the control period T_CTRL while being supplied with the electrical energy E with the charge period T_L and the discharge period T_EL determined in step S3. The electrical energy E is supplied to the piezo actuator 75 preferably by direct specification of the electrical energy E that is to be supplied, though it can also be supplied by means of a corresponding specification of a current profile or also of a voltage curve, in which cases temperature-dependent changes in capacitance of the piezo actuator should preferably at least be taken into account.

The time position of the respective control period T_CTRL relative to the crankshaft angle can then be freely selected if a corresponding function for converting an actuation of an output stage of the control device 35 allows this at an arbitrary moment in time and also if the output stage is so designed. Frequently, however, the control device 35 is embodied for controlling the piezo actuator 75 in each case only within the cylinder segment ZS1-ZS4 assigned to the respective cylinder Z1 to Z4. The cylinder segment ZS1 to ZS4 is understood to mean that crankshaft angle, and consequently a corresponding time period, which results from the crankshaft angle for a working cycle of the internal combustion engine divided by the number of cylinders. In the case of an internal combustion engine with a working cycle of 720° crankshaft and, for example, four cylinders, a cylinder segment is thus equal to 180° crankshaft angle. The time period assigned to the respective cylinder segment is then dependent on the current rotation of the crankshaft 15. The cylinder segments assigned to the respective cylinders have a predefined position in relation to a reference angle position of the crankshaft which can be, for example, a top dead center of the piston upon ignition.

In a step S11, a check is then made to determine whether the pressure curve P_V recorded by the high-pressure sensor 33 has a characteristic pressure curve P_V_M for a movement of the control valve 43 out of its closed position without fluid being metered through the injection port 61. The characteristic pressure curve P_V_M is preferably determined in advance by appropriate trials or simulations and stored in the data memory of the control device 35. Preferably it is determined such that the valve body 77 and hence the control valve 43 moves only the minimum possible amount from its closed position and consequently a minimal flow of fuel flows from the control chamber 55 through the outlet throttle 73 past the control valve 43 to the low-pressure chamber 49 when the pressure curve P_V corresponds to the characteristic pressure curve P_V_M.

Preferably the condition of step S11 is also met when the pressure curve P_V lies in a predefinable, preferably narrow, value range window about the characteristic pressure curve P_V_M. The characteristic pressure curve P_V_M can be represented for example by a predefinable change in the pressure or a predefinable change rate of the pressure, which is also referred to as a gradient, or also a further correspondingly representative quantity.

If the condition of step S11 is not met, in a step S17 an incrementation period DT is added to the control period T_CTRL. In addition or also as an alternative thereto, in step S17 an incrementation energy DE is added to the electrical energy E that is to be supplied. The incrementation period DT and the incrementation energy DE are set to such small values that it can be ensured with a high degree of probability that in a corresponding controlling of the injector 7-13 in a subsequent pass through step S8 there will continue to be no metering of fuel through the injection port 61.

Depending on the embodiment of the program, it is also possible in step S17 to vary only either the control period T_CTRL or the electrical energy E to be supplied. This can also be done differently in succeeding passes through step S17. Following step S17, processing is then resumed in step S7.

If, on the other hand, the condition of step S11 is met, the control period T_CTRL is assigned to a target control period T_CTRL_Z in a step S13. In step S13 in addition, the electrical energy E to be supplied is assigned to a target energy E_Z. The method is then terminated in step S15.

The target energy E_Z determined in step S13 and the target control period T_CTRL_Z can be a measure for the idle stroke of the control valve 43, either each taken individually or in combination.

As a function of, for example, reference values for the target energy E_Z or, as the case may be, the target control period T_CTRL_Z that are also stored in the control device 35, for the subsequent operation of the injector 7 to 13 with metering of fuel through the injection port 61, control times or also electrical energies to be supplied that are provided therefor can then be adjusted accordingly and thereby a very precise metering of the desired fuel quantity can be achieved. Furthermore, the target control period T_CTRL_Z and/or the target energy E_Z can also be used for diagnosis of the injector 7-13. Thus, for example, if one or both values of the target control period T_CTRL_Z or the target energy E_Z are exceeded, it can be deduced that there is a fault in the injector and appropriate measures can be initiated, consisting for example in no further actuating of the injector or in a warning message to a user of a vehicle in which the internal combustion engine is disposed.

Figure 5:
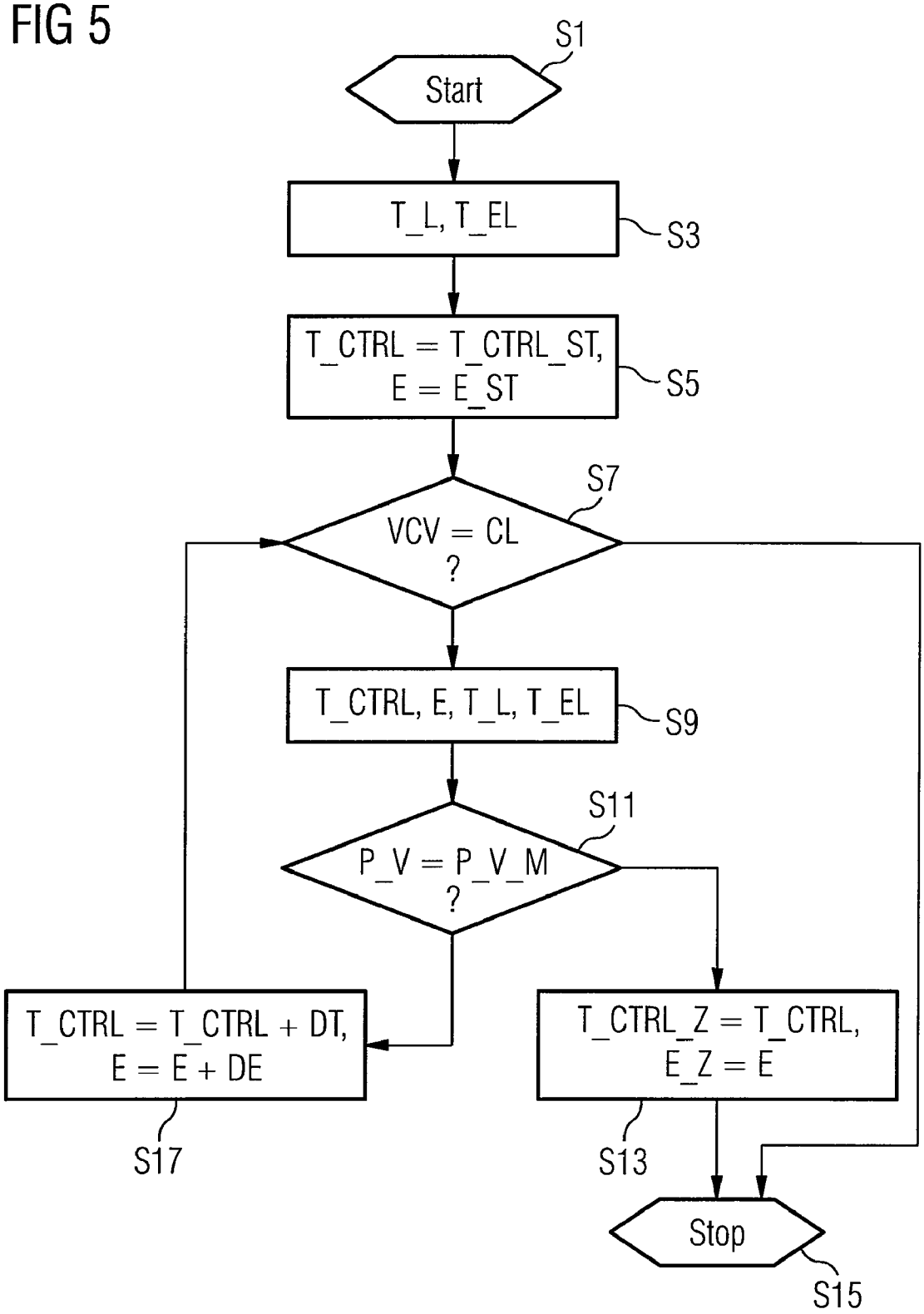
FIG. 5 is a flowchart of a program for controlling the injector.

The program for controlling the injector according to FIG. 5 is preferably executed for each of the injectors 7-13 and consequently different control periods T_CTRL_Z and target energies E_Z can then also be determined for each of the injectors 7-13. By this means injector-specific differences can thus be compensated for and as a result a consistent metering of fuel across the cylinders Z1 to Z4 of the internal combustion engine can be guaranteed.

The program according to FIG. 5 is preferably executed in an overrun phase of operation of the vehicle, during which no fuel is delivered to the cylinders of the internal combustion engine, or also executed immediately after the internal combustion engine has been turned off.

In these operating states a user of the internal combustion engine expects to perceive no noises caused by an actuating of the injectors 7 to 13. For this reason it is important in ensuring that the user of the vehicle experiences a feeling of great comfort to minimize the sound emissions caused by the execution of the program according to FIG. 5 in such a way that the user of the vehicle at least subjectively does not perceive them or at least does not perceive them as unpleasant. Toward that end, in addition to a suitable selection of the charge period T_L or the discharge period T_EL, as described with reference to step S3, further measures can also be advantageously performed which are explained in the following with reference to FIGS. 6A to 6D and 7.

In FIGS. 6A to 6D, control pulses assigned in each case to the respective injection valves 7-13 of the respective cylinders Z1 to Z4 are plotted, said control pulses being generated in each case during the execution of step S9 in the respective injector 7 to 13. Control pulses for the piezo actuator 75 of the injector 7 which is assigned to the cylinder Z1 are in each case executed in the cylinder segment ZS1 assigned to the cylinder Z1. This applies analogously to the control pulses of the remaining injectors 9-13. The height of the control pulses can be representative of the energy E supplied during the control pulse. The respective control pulses are varied in relation to the respective cylinder segment with regard to their start and/or end, which can be seen by reference to their different position relative to the respective cylinder segment ZS1-ZS4. In addition, the end and/or the start of the respective control period T_CTRL of control pulses assigned to different injectors 7-13 can be varied relative to one another. This is also the case in relation to the different position of the control pulses relative to the respective start of the respective cylinder segment ZS1 to ZS4 in the signal shapes of FIGS. 6A to 6D. By means of a corresponding fine-tuning of this varying in relation to the respective cylinder segment it is possible to generate in a targeted manner a desired sound spectrum which is, for example, either not perceived at all by the user or is perceived only as hissing or which is assimilated into other operating noises of the internal combustion engine.

The illustration of the control pulses in FIGS. 6A to 6D does not necessarily have to correspond to the actual signal shape of the corresponding physical quantities. In particular the electrical energy supplied to the piezo actuator 75 is removed again at the end of the control period.

Referring to FIG. 7, a possible shape of a control pulse is depicted in greater detail. During the control period T_CTRL, electrical energy is supplied to the piezo actuator 75 for the predefined charge period T_L. This is effected preferably by means of corresponding energy pulses which are preferably varied in their height and hence in the supplied power PEL when the energy E to be supplied is varied. Directly following the termination of the control period T_CTRL, the piezo actuator 75 is then discharged again by means of corresponding discharge pulses of opposite polarity and moreover over the discharge period T_EL.

The term "fuel" is used in the exemplary embodiments purely by way of example for a special fluid. It can, however, also be replaced by fluid.

What is claimed is:

1. A method for controlling an injector comprising a nozzle needle whose position is adjustable as a function of a pressure in a control chamber and which in a closed position prevents a fluid flow through at least one injection port and otherwise releases said fluid flow, the control chamber which is hydraulically coupled to a high-pressure fluid accumulator, a piezo actuator, and a control valve which in its closed position hydraulically decouples the control chamber from a low-pressure chamber which outside of the closed position hydraulically couples the control chamber to the low-pressure chamber and upon which the piezo actuator acts, the method comprising the step of:

varying a combination of a control period of the piezo actuator and an electrical energy to be supplied to the piezo actuator starting from a predefined initial combination to a target combination in which a pressure curve is recorded which is characteristic of a movement of the control valve out of its closed position without a metering of fluid taking place through the injection port.

2. The method according to claim 1, wherein the varying of the combination of the control period and the electrical energy to be supplied takes place in an operating state in which an actuating element for adjusting the fluid delivery to the high-pressure fluid accumulator is in its closed state.

3. The method according to claim 1, wherein the varying of the combination of the control period and the supplied electrical energy is effected by means of a charge period during which the piezo actuator is supplied with electrical energy, which charge period is longer than that during an operation phase of the injector in which a metering of fluid is intended.

4. The method according to claim 1, wherein the varying of the combination of the control period and the supplied electrical energy is effected by means of a discharge period during which electrical energy is removed from the piezo actuator, which discharge period is longer than that during an operation phase of the injector in which a metering of fluid is intended.

5. The method according to claim 1, wherein a commencement of succeeding control periods is varied in relation to the respective cylinder segment.

6. The method according to claim 1, wherein a termination of succeeding control periods is varied in relation to the respective cylinder segment.

7. The method according to claim 1, wherein the commencement of succeeding control periods for different injectors is varied in relation to the respective cylinder segment.

8. The method according to claim 1, wherein the termination of succeeding control periods for different injectors is varied in relation to the respective cylinder segment.

9. A device for controlling an injector comprising:

a nozzle needle whose position is adjustable as a function of a pressure in a control chamber and which in a closed position prevents a fluid flow through at least one injection port and otherwise releases said fluid flow, the control chamber which is hydraulically coupled to a high-pressure fluid accumulator, a piezo actuator and a control valve which in its closed position hydraulically decouples the control chamber from a low-pressure chamber which outside of the closed position hydraulically couples the control chamber to the low-pressure chamber and upon which the piezo actuator acts, wherein the device is operable to vary a combination of a control period of the piezo actuator and an electrical energy to be supplied to the piezo actuator starting from a predefined initial combination to a target combination in which a pressure curve is recorded which is characteristic of a movement of the control valve out of its closed position without fluid being metered through the injection port.

10. The device according to claim 9, wherein the varying of the combination of the control period and the electrical energy to be supplied takes place in an operating state in which an actuating element for adjusting the fluid delivery to the high-pressure fluid accumulator is in its closed state.

11. The device according to claim 9, wherein the varying of the combination of the control period and the supplied electrical energy is effected by means of a charge period during which the piezo actuator is supplied with electrical energy, which charge period is longer than that during an operation phase of the injector in which a metering of fluid is intended.

12. The device according to claim 9, wherein the varying of the combination of the control period and the supplied electrical energy is effected by means of a discharge period during which electrical energy is removed from the piezo actuator, which discharge period is longer than that during an operation phase of the injector in which a metering of fluid is intended.

13. The device according to claim 9, wherein a commencement of succeeding control periods is varied in relation to the respective cylinder segment.

14. The device according to claim 9, wherein a termination of succeeding control periods is varied in relation to the respective cylinder segment.

15. The device according to claim 9, wherein the commencement of succeeding control periods for different injectors is varied in relation to the respective cylinder segment.

16. The device according to claim 9, wherein the termination of succeeding control periods for different injectors is varied in relation to the respective cylinder segment.

17. A method for controlling an injector comprising the step of varying a combination of a control period of a piezo actuator and an electrical energy to be supplied to the piezo actuator starting from a predefined initial combination to a target combination in which a pressure curve is recorded which is characteristic of a movement of a control valve out of its closed position without a metering of fluid taking place through an injection port.

18. The method according to claim 17, wherein the varying of the combination of the control period and the electrical energy to be supplied takes place in an operating state in which an actuating element for adjusting the fluid delivery to the high-pressure fluid accumulator is in its closed state.

19. The method according to claim 17, wherein the varying of the combination of the control period and the supplied electrical energy is effected by means of a charge period during which the piezo actuator is supplied with electrical energy, which charge period is longer than that during an operation phase of the injector in which a metering of fluid is intended.

20. The method according to claim 17, wherein the varying of the combination of the control period and the supplied electrical energy is effected by means of a discharge period during which electrical energy is removed from the piezo actuator, which discharge period is longer than that during an operation phase of the injector in which a metering of fluid is intended.

* * * * *